US008270632B2

(12) United States Patent
Hwang et al.

(10) Patent No.: US 8,270,632 B2
(45) Date of Patent: Sep. 18, 2012

(54) SOUND SOURCE LOCALIZATION SYSTEM AND METHOD

(75) Inventors: Do Hyung Hwang, Gyeonggi-do (KR); JongSuk Choi, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 240 days.

(21) Appl. No.: 12/844,004

(22) Filed: Jul. 27, 2010

(65) Prior Publication Data

US 2011/0222707 A1 Sep. 15, 2011

(30) Foreign Application Priority Data

Mar. 15, 2010 (KR) ..... 10-2010-0022697

(51) Int. Cl.
*H04R 3/00* (2006.01)

(52) U.S. Cl. ..... 381/92; 381/313; 367/118; 367/127

(58) Field of Classification Search ..... 381/92, 381/94.2, 94.1, 98, 313, 317; 367/118, 123–125, 367/127; 704/233; 379/388.04
See application file for complete search history.

(56) References Cited

U.S. PATENT DOCUMENTS

| | | | | |
|---|---|---|---|---|
| 6,719,700 | B1 * | 4/2004 | Willis | 600/462 |
| 7,495,998 | B1 * | 2/2009 | Deligeorges et al. | 367/127 |
| 7,586,513 | B2 * | 9/2009 | Muren et al. | 348/14.01 |
| 2010/0217590 | A1 * | 8/2010 | Nemer et al. | 704/233 |

FOREIGN PATENT DOCUMENTS

KR 10-2009-0038697 A 4/2009

* cited by examiner

*Primary Examiner* — Vivian Chin
*Assistant Examiner* — Friedrich W Fahnert
(74) *Attorney, Agent, or Firm* — Dickstein Shapiro LLP

(57) ABSTRACT

A sound source localization system includes a plurality of microphones for receiving a signal as an input from a sound source; a time-difference extraction unit for decomposing the signal inputted through the plurality of microphones into time, frequency and amplitude using a sparse coding and then extracting a sparse interaural time difference (SITD) inputted through the plurality of microphones for each frequency; and a sound source localization unit for localizing the sound source using the SITDs. A sound source localization method includes receiving a signal as an input from a sound source; decomposing the signal into time, frequency and amplitude using a sparse coding; extracting an SITD for each frequency; and localizing the sound source using the SITDs.

12 Claims, 9 Drawing Sheets

PRIOR ART

PRIOR ART

SOUND SOURCE LOCALIZATION SYSTEM AND METHOD

CROSS-REFERENCE TO RELATED APPLICATION

This application claims priority from and the benefit of Korean Patent Application No. 10-2010-0022697, filed on Mar. 15, 2010, which is hereby incorporated by reference for all purposes as if fully set forth herein.

BACKGROUND

1. Field of the Invention

Disclosed herein is a sound source localization system and method.

2. Description of the Related Art

In general, among auditory techniques for intelligent robots, a sound source localization technique is a technique for localizing the position at which a sound source is generated by analyzing properties of a signal inputted from a microphone array. That is, the sound source localization technique is a technique capable of effectively localizing a sound source generated from a human robot interaction and a place beyond the sight of a vision camera.

FIG. 1 is a diagram showing a related art sound source localization technique using a microphone array.

In related art sound source localization techniques, a microphone array has the form of a specific structure as shown in FIG. 1, and a sound source is localized using such a microphone array. In the technique, a direction angle is mainly detected by measuring a difference in time at which a voice signal reaches each microphone from the sound source. Hence, when using the technique, an object that interrupt the flow of a voice signal between the respective microphones is not necessarily exists so that exact measurement is possible. However, in the case of using two ears of an actual human being, there may occur a problem in the sound source localization technique.

FIG. 2 is a diagram illustrating a problem caused when the related art sound source localization technique is applied to a sound source localization technique using two ears.

Referring to FIG. 2, when the related art sound source localization technique is used in an actual robot technique using two ears, properties of a signal inputted to the two ears from a sound source are changed due to the influence of a face and an ear between microphones, and therefore, performance may be degraded.

A method using a head related transfer function (HRTF) has been proposed so as to solve such a problem. In the method using the HRTF, the influence caused by a platform is removed by re-measuring respective impulse responses based on the forms of the corresponding platform. However, in order to measure impulse responses, signals based on respective directions are necessarily obtained in a dead room, and hence, measurement is complicated whenever the form of the platform is changed. Therefore, the method using the HRTF has a limitation in its application to robot auditory systems with various types of platforms.

In addition, since related art sound source localization systems are sensitively reacted to changes in environment, programs and the like are necessarily modified to make a setting suitable for a change in environment. Therefore, there are many problems in that the related art sound source localization systems are applied to the human robot interaction in which various variables still exist.

SUMMARY OF THE INVENTION

Disclosed herein is a sound source localization system and method in which a sparse coding and a self-organized map (SOM) are used to implement sound source localization using a sound source localization path of a human being as a model, so that the system and method can be applied to various types of platforms because impulse responses are unnecessary to be measured every time, and can be used in various robot development fields because it is possible to be adapted to a change in environment.

In one embodiment, there is provided a sound source localization system including: a plurality of microphones for receiving a signal as an input from a sound source; a time-difference extraction unit for decomposing the signal inputted through the plurality of microphones into time, frequency and amplitude using a sparse coding and then extracting a sparse interaural time difference (SITD) inputted through the plurality of microphones for each frequency; and a sound source localization unit for localizing the sound source using the SITDs.

In one embodiment, there is provided a sound source localization method including: receiving a signal as an input from a sound source; decomposing the signal into time, frequency and amplitude using a sparse coding; extracting an SITD for each frequency; and localizing the sound source using the SITDs.

BRIEF DESCRIPTION OF THE DRAWINGS

The above and other aspects, features and advantages disclosed herein will become apparent from the following description of preferred embodiments given in conjunction with the accompanying drawings, in which.

DETAILED DESCRIPTION OF THE INVENTION

Figure 1:
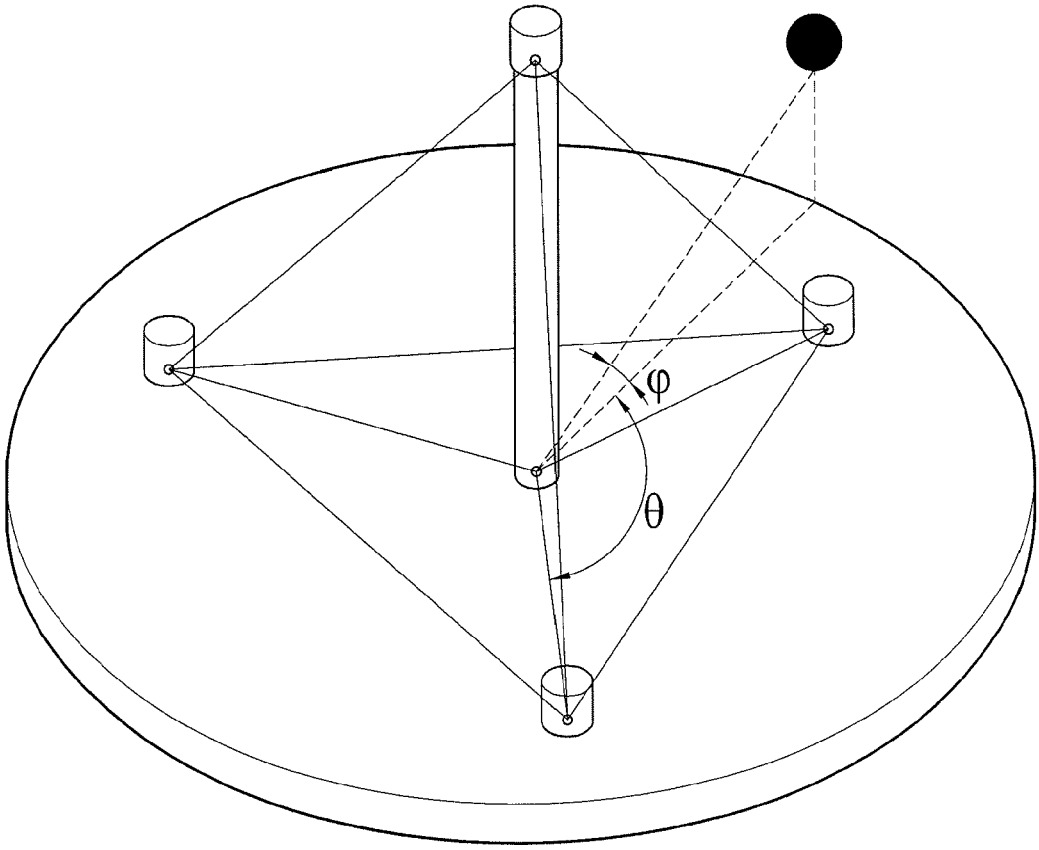
FIG. 1 is a diagram showing a related art sound source localization technique using a microphone array.
Figure 2:
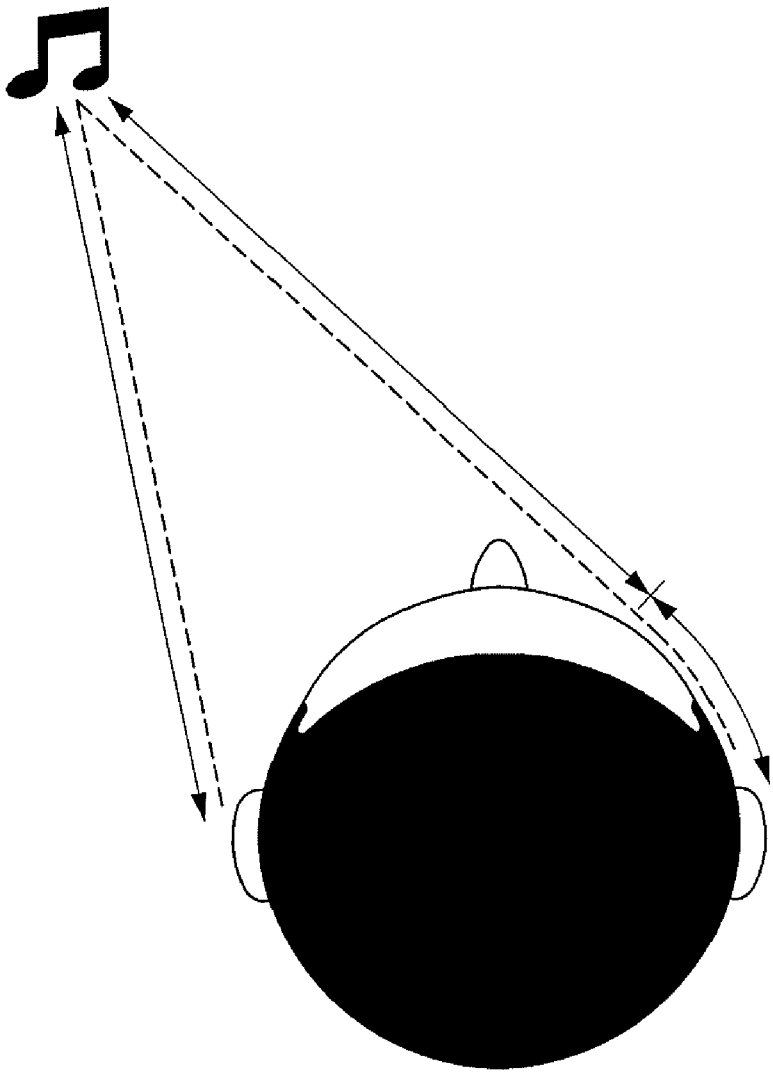
FIG. 2 is a diagram illustrating a problem caused when the related art sound source localization technique is applied to a sound source localization technique using two ears.

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals in the drawings denote like elements. The shape, size and regions, and the like, of the drawing may be exaggerated for clarity.

Figure 3:
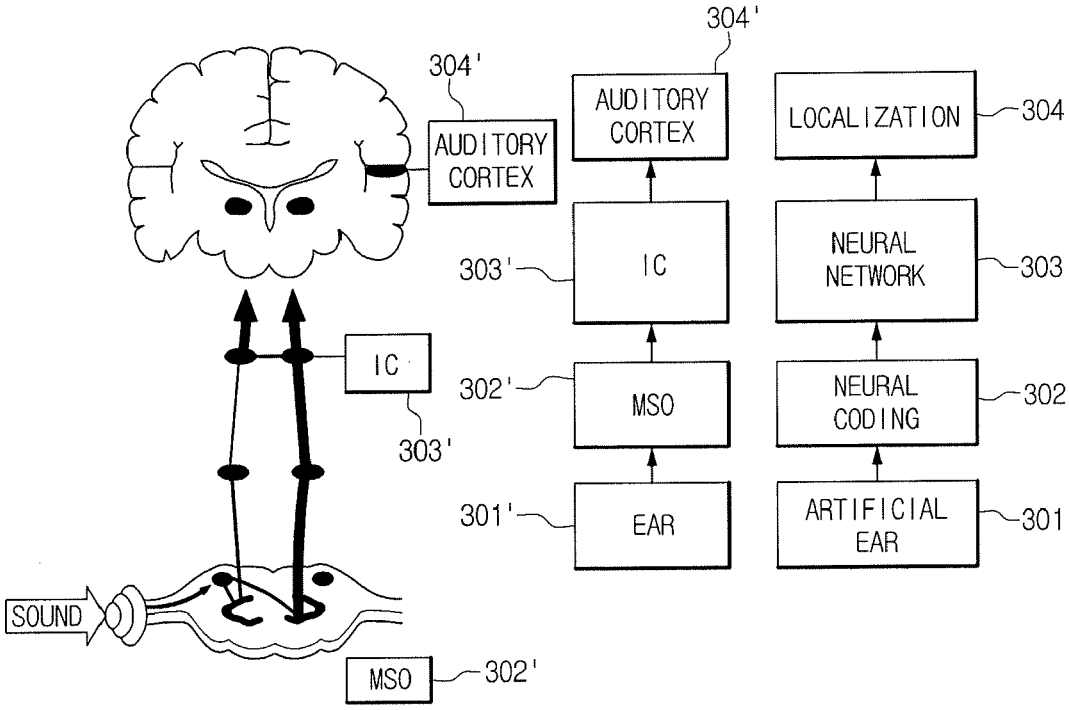
FIG. 3 is a diagram illustrating a correspondence relation between a human's sound source localization system and a sound source localization system according to an embodiment.

FIG. 3 is a diagram illustrating a correspondence relation between a human's sound source localization system and a sound source localization system according to an embodiment.

Referring to FIG. 3, a generated sound source signal is inputted through two (two-channel) microphones attached to an artificial ear (Kemar ear) 301 corresponding to a human's ear 301'. Then, the inputted sound source signal is digitalized for sound source localization. Since the inputted signal is processed based on a cognition model of a human's auditory sense, the sound source localization system corresponds to organs that play roles in the human's auditory sense. The localization of the inputted sound source divided into two parts, i.e., a neural coding 302 and a neural network 303. The part of the neural coding 302 serves as a medial superior olive (MSO) 302' that extracts a sparse interaural time difference (SITD) used for the sound source localization. The part of the neural network 303 serves as an inferior colliculus (IC) 303' that localizes a sound source and plays a role of learning. Like the sound source localization performed in an auditory cortex 304', a sound source localization 304 is also performed in the sound source localization system according to the embodiment by passing through the parts of the neural coding 302 and the neural network 303.

It has been described in this embodiment that the number of microphones used is two. However, this is provided only for illustrative purposes, and is not limited thereto. That is, the sound source localization system according to the embodiment may be provided with three or more microphones as occasion demands. For example, the sound source localization system according to the embodiment may be applied in such a manner that a plurality of microphones are divided into two groups and the two groups are respectively disposed at the left and right of a model with the contour of a human's face, or the like.

Figure 4:
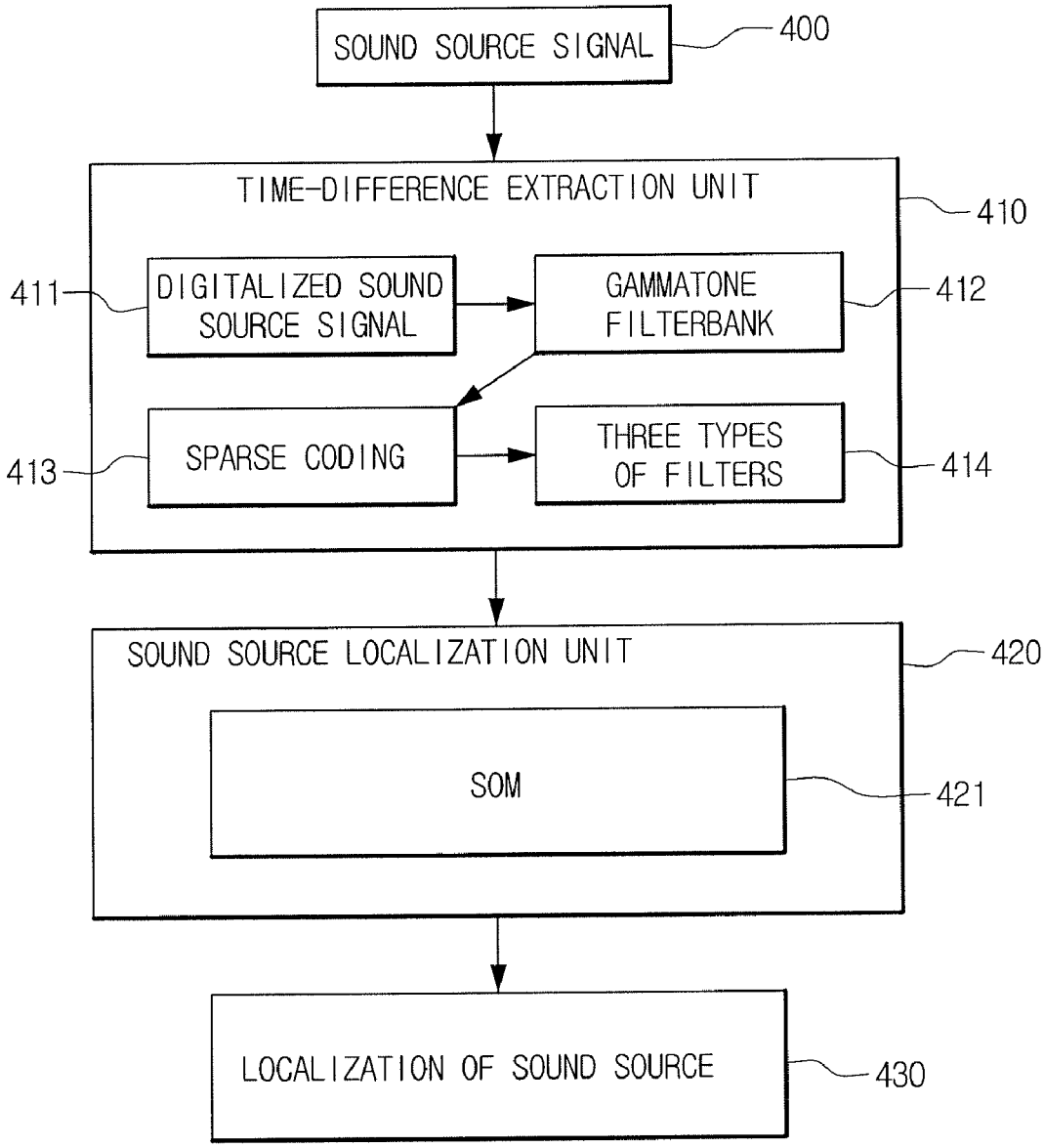
FIG. 4 is a block diagram schematically showing the sound source localization system according to the embodiment.

FIG. 4 is a block diagram schematically showing the sound source localization system according to the embodiment.

As previously described in FIG. 3, the sound source localization system according to the embodiment is generally divided into a neural coding and a neural network. Referring to FIG. 4, since the neural coding extracts an SITD, it may correspond to a time-difference extraction unit 410. Since the neural network localizes a sound source using the SITD, it may correspond to a sound source localization unit 420.

The algorithm of the time-difference extraction unit 410 may be performed as follows. A sound source signal 400 is first inputted through two (two-channel) microphones and then digitalized for signal processing. When the inputted sound source signal 400 is digitalized, it may be digitalized at a desired sampling rate, e.g., 16 kHz. The digitalized sound source signal 411 may be inputted as a unit of frame (200 ms) to a gammatone filterbank 412 having 64 different center frequencies. Here, the digitalized sound source signal 411 may be filtered for each of the frequencies and then inputted to a sparse coding 413. An SITD may be evaluated by passing through the sparse coding 413, and errors may be removed from the evaluated SITD by passing through three types of filters 414. The three types of filters 414 will be described later.

The algorithm of the time-difference extraction unit 410 will be described in detail. As described above, the sound source signal 400 is inputted through the two (two-channel) microphones and then digitalized. The digitalized sound source signal is divided as a unit of frame (200 ms) and then transferred to a gammatone filterbank 412. Here, if the sound source localization is performed by two artificial ears disposed as human's ears, the SITD is changed by the influence of a facial surface. In order to effectively solve such a problem, the SITD is necessarily evaluated, and hence, the gammatone filterbank 412 for filtering the sound source signal for each frequency is used in the sound source localization system according to the embodiment. The gammatone filterbank 412 is a filter structure obtained by performing modeling with respect to sound processing in a human's outer ear. Particularly, as the gammatone filterbank 412 includes a set of bandpass filters that serve as cochleae, the impulse response of the filterbank is evaluated using a gammatone function as shown in the following equation 1.

$$h(t)=r(n,b)t^{n-1}e^{-bt}\cos(\omega t+\phi)u(t) \tag{1}$$

Here, r(n,b) denotes a normalization factor, b denotes a bandwidth, and w denotes a center frequency.

As can be seen in Equation 1, the number of filters and the center frequency and bandwidth of the filterbank are required to produce the gammatone filterbank. Generally, the number of filters is determined by the maximum frequency ($f_H$) and the minimum frequency ($f_L$). The number of filters is evaluated by the following equation 2. In this embodiment, the maximum and minimum frequencies are set as 100 Hz and 8 KHz, respectively, and the number of filters is then evaluated.

$$n = \frac{9.26}{v}\ln\frac{f_H + 228.7}{f_L + 228.7} \tag{2}$$

Here, v denotes the number of overlapped filters. The center frequency is evaluated by the following equation 3.

$$f_c = -228.7 + (f_H + 228.7)e^{-\frac{vn}{9.26}} \quad (3)$$

The number of filters and the center frequency of the filterbank are evaluated using the aforementioned equations, and 64 gammatone filters are then produced by applying the bandwidth of an equivalent rectangular bandwidth (ERB) filter. The ERB filter is a filter proposed on the assumption that the auditory filter has a rectangular shape and the same noise power is passed in the same critical bandwidth. The bandwidth of the ERB filter is generally used for the gammatone filter.

In this embodiment, the technique of a sparse coding 412 is used in which the inputted sound source signal is decomposed into three factors of time, frequency and amplitude. In the technique of the sparse coding 412, a general signal is decomposed into three factors of time, frequency and amplitude by the following equation 4, using a sparse and kernel method.

$$x(t) = \sum_{m=1}^{M} \sum_{i=1}^{n_m} s_i^m \phi_m(t - T_i^m) + \varepsilon(t) \quad (4)$$

Here, $T_i^m$ denotes a time, $S_i^m$ denotes a coefficient of an i-th time, $\phi_m$ denotes a kernel function, $n_m$ denotes the number of kernel functions, and $\epsilon(t)$ denotes a noise. As can be seen in Equation 4, all signals can be expressed as the sum of coefficients of the kernel functions at a time t and noises using the sparse and kernel method. The kernel function disclosed herein is a gammatone filterbank. Since the gammatone filterbank has various frequency bands, each of the signals may be decomposed into three factors of time, frequency and amplitude.

Here, various algorithms may be used to decompose the inputted signal into the generated kernel function. A matching pursuit algorithm has been used in this embodiment. The time difference between two channels (signals of left and right ears, i.e., signals of left and right microphones) is extracted for each frequency by decomposing the signal into a kernel function for each channel and a combination of coefficients using the matching pursuit algorithm and then detecting the maximum coefficient for each of the channels. The extracted time difference is referred to as an SITD named after a sparse ITD. The extracted SITD is transferred to the neural network, i.e., the sound source localization unit 420, so that the sound source is localized.

When the SITD is calculated in the sparse coding, the signal inputted with 16 KHz is divided by 200 msec to use 3200 data. Then, 25% of the data is overlapped in the calculation of the next frame. In one frame, there exist SITDs of 64 channels. However, when all the channels are used, this may have a bad influence on the sound source localization due to problems of an environmental noise, a small coefficient and the like. In order to remove such an influence, the aforementioned three types of filters 414 are used in this embodiment.

A first filter is referred to as a mean-variance filter. The first filter is a filter that evaluates the Gaussian mean of the SITDs and removes SITDs of which errors are greater than a predetermined value based on the evaluated mean. The predetermined value is a value predetermined by a user within an error range that is not considered as a normal signal. A second filter is a bandpass filter in which only the SITD result of the gammatone filterbank in a corresponding region is used in a voice band. The sound band refers to a band of 500 to 4000 Hz. A third filter is a filter that removes errors when the coefficient of the extracted SITD is smaller than a specific threshold determined by a user.

Although the aforementioned filters are referred to as first, second and third filters, respectively, the order of the filters is not particularly limited. Each of the filters is not essential, and some or all of the filters may be deleted or added as occasion demands. The filters are provided only for illustrative purposes, and other types of filters may be used.

FIGS. 5A to 5D are graphs showing results obtained by applying filters of the sound source localization system according to the embodiment.

Figure 5A:
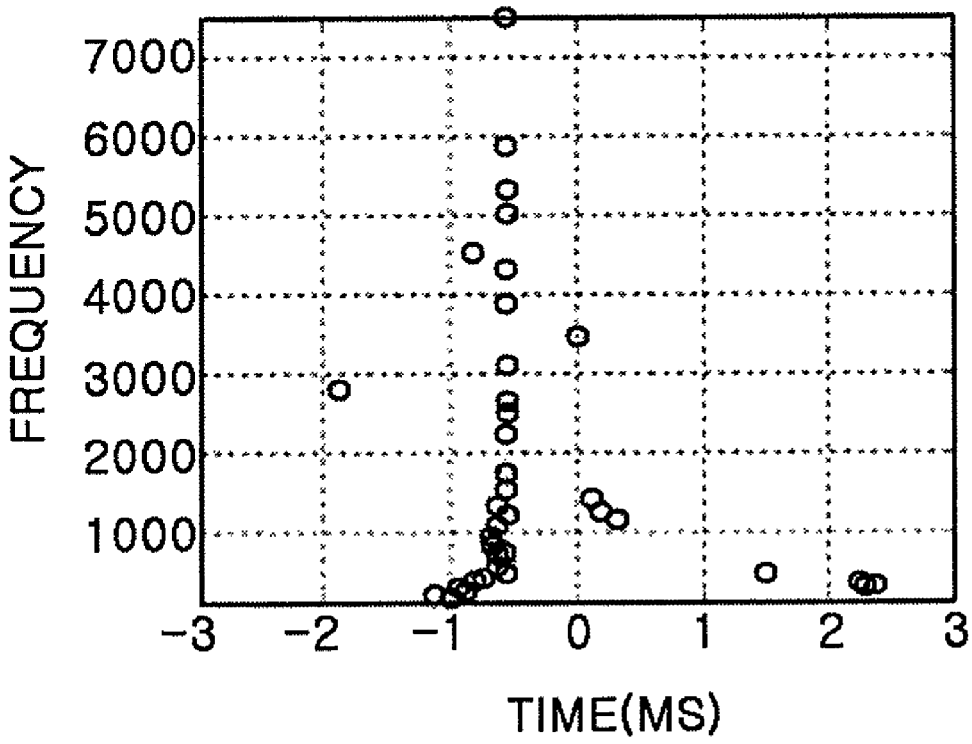
FIGS. 5A to 5D are graphs showing results obtained by applying filters of the sound source localization system according to the embodiment.

FIG. 5A is a graph of an SITD that does not passes through filtering. That is, the SITD that passes through the gammatone filterbank, the sparse coding and the like is represented by a spike-gram as shown in FIG. 5A. In FIG. 5A, it can be seen that calculated values are not equal and values with large errors exist.

Figure 5B:
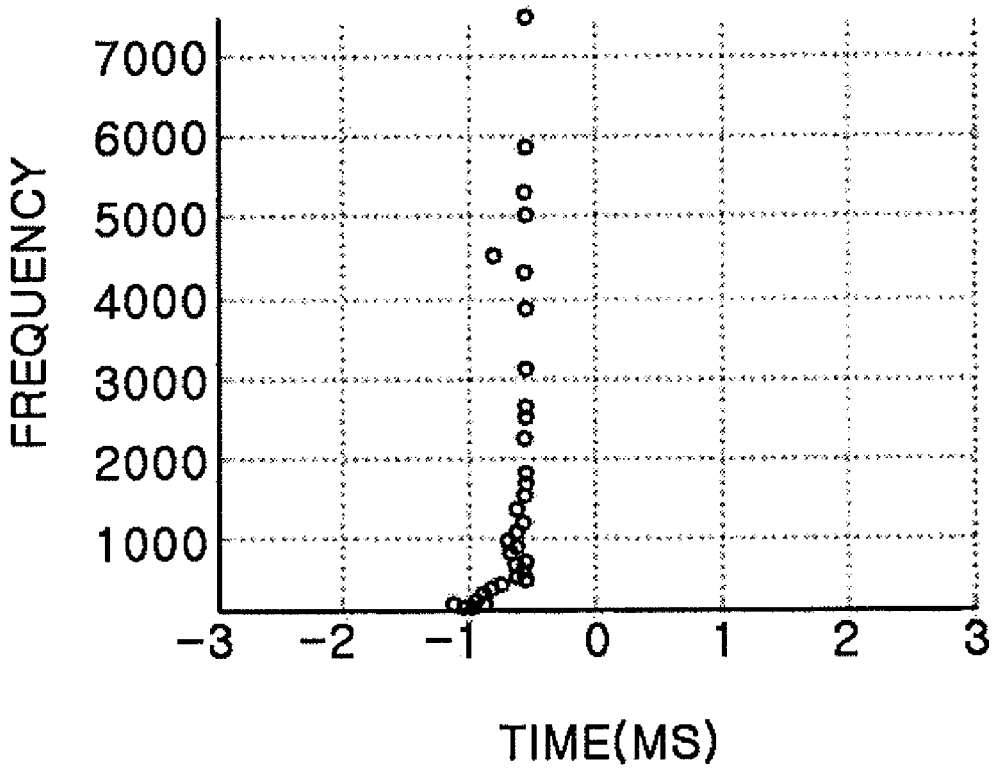
Figure 5C:
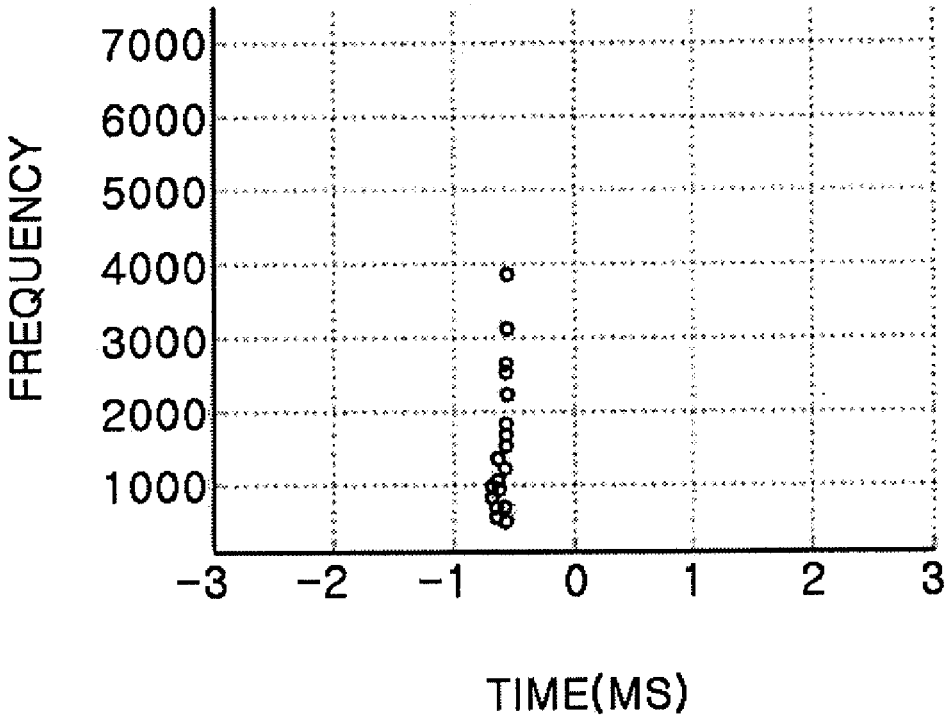
Figure 5D:
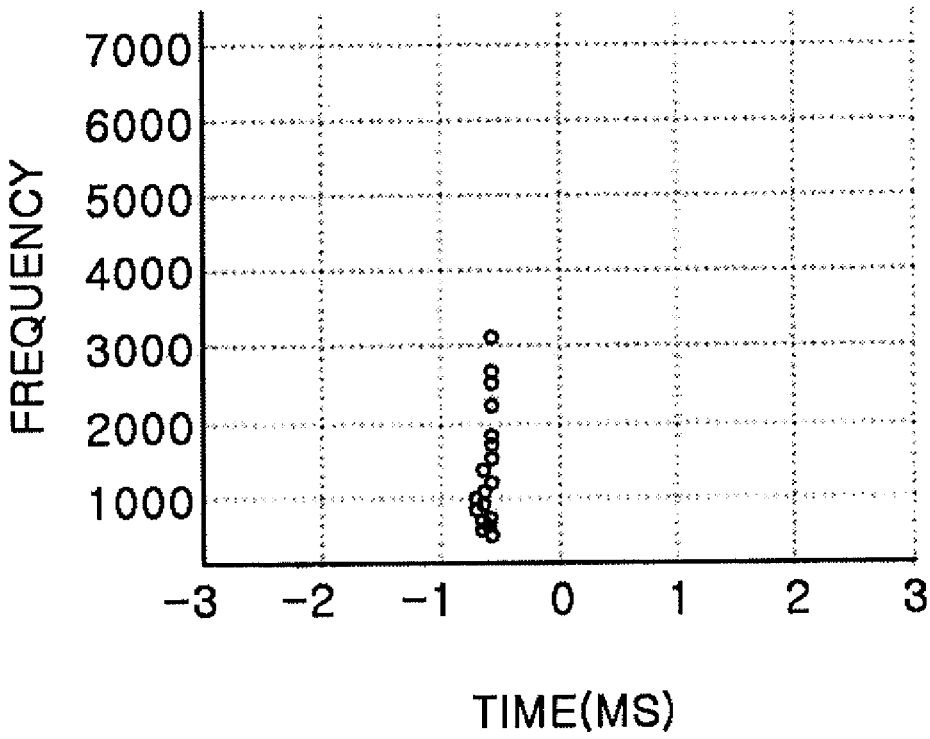

FIG. 5B shows a result obtained by passing through the first filter, and FIG. 5C shows a result obtained by sequentially passing through the first and second filters. FIG. 5D shows a result obtained by sequentially passing through the first, second and third filters. As described above, the order of the filtering processes is not particularly limited, and the same result is derived even though the order of the filtering processes is changed. Any one of the filtering processes may be deleted or added as occasion demands, and the result becomes more accurate as the number of filtering processes is increased. As can be seen in FIGS. 5B to 5D, the SITD results are equalized as the filtering processes are performed one by one.

Referring back to FIG. 4, the SITD that passes through the aforementioned filtering processes is inputted to the neural network, i.e., the sound source localization unit 420 as an input.

The sound source localization unit 420 in the sound source system according to the embodiment may use a self-organizing map (SOM) 421 that is one of neural networks. As described in the background section, in the related art sound source localization system, ITDs are calculated using the head related transfer function (HRTF) at each frequency bandwidth. However, in order to precisely implement the HRTF, impulse responses are necessarily measured by changing an angle and generating a sound source in a dead room. Hence, many costs and resources are consumed in constructing the system.

Contrastively, in the SOM of the sound source localization unit 420 in the sound source localization system according to the embodiment, a learning process is performed using the system constructed in the initialized SOM and the SITD estimated through the neural coding in an actual environment, and the result is then estimated from the SOM. Unlike the general neural network, the on-line learning of the SOM is possible. Therefore, the SOM can be adapted to a change in ambient environment, hardware or the like, as the same principle that a human being is adapted to a change in the function of an auditory sense.

The localization of the sound source 430 can be performed by passing the inputted sound source signal through the time-difference extraction unit 410 and the sound source localization unit 420.

Figure 6:
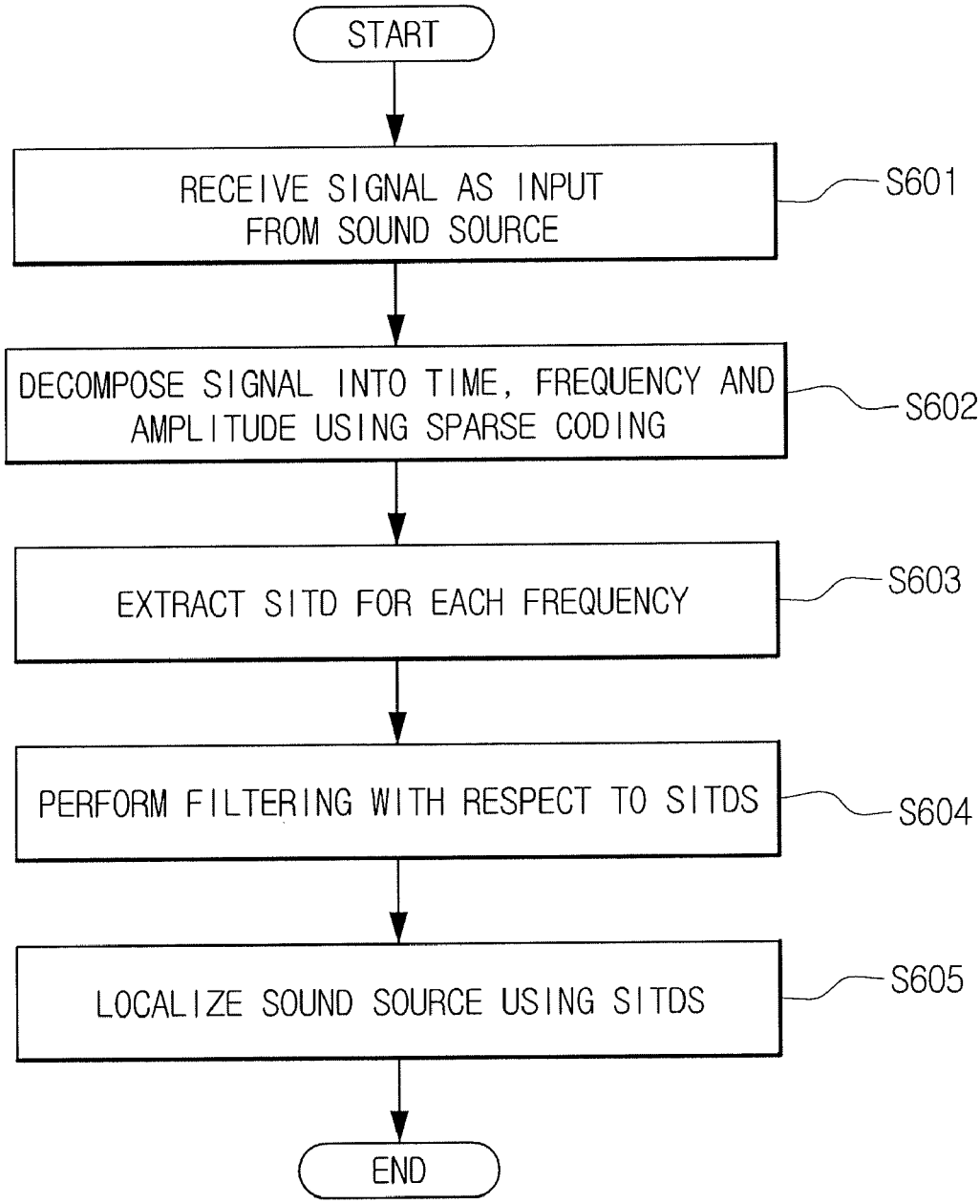
FIG. 6 is a flowchart schematically illustrating a sound source localization method according to an embodiment.

FIG. 6 is a flowchart schematically illustrating a sound source localization method according to an embodiment.

In the sound source localization method according to the embodiment, a signal is received as an input from a sound source (S601). Subsequently, the inputted signal is decomposed into time, frequency and amplitude using a sparse coding (S602). Then, an SITD is extracted for each frequency using the separated signal (S603).

The SITDs are filtered by several filters (S604). For example, the SITDs may be filtered by first, second and third filters. Here, the first filter is a filter that evaluates the Gaussian mean of the SITDs and removes SITDs of which errors are greater than a predetermined value based on the evaluated mean. The second filter is a filter that passes only SITDs within a voice band among the SITDs. The third filter is a filter that passes only SITDs of which coefficients are smaller than a predetermined threshold. Although these filters are referred to as first, second and third filters, respectively, the order of the filters is not particularly limited. Each of the filters is not essential, and some or all of the filters may be deleted or added as occasion demands. The filters are provided only for illustrative purposes, and other types of filters may be used.

The sound source is localized using the SITDs that pass through the aforementioned filtering processes (S605). The operation S605 can be performed by learning the SITDs and localizing the sound source using the learned SITDs.

The sound source localization method described above has been described with reference to the flowchart shown in FIG. 6. For brief description, the method is illustrated and described using a series of blocks. However, the order of the blocks is not particularly limited, and some blocks may be performed simultaneously or in a different order from the order illustrated and described in this specification. Also, various orders of other branches, flow paths and blocks may be implemented to achieve the identical or similar result. All the blocks shown in FIG. 6 may not be required to implement the method described in this specification.

In the sound source localization system and method, disclosed herein, a sparse coding and a self-organized map (SOM) are used to implement sound source localization using a sound source localization path of a human being as a model, so that the system and method can be applied to various types of platforms because impulse responses are unnecessary to be measured every time, and can be used in various robot development fields because it is possible to be adapted to a change in environment.

While the disclosure has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A sound source localization system, comprising:

a plurality of microphones for receiving a signal as an input from a sound source;

a time-difference extraction unit for decomposing the signal inputted through the plurality of microphones into time, frequency and amplitude using a sparse coding and then extracting a sparse interaural time difference (SITD) inputted through the plurality of microphones for each frequency; and a sound source localization unit for localizing the sound source using the SITDs.

2. The sound source localization system according to claim 1, wherein the time-difference extraction unit performs the sparse coding using a gammatone filterbank.

3. The sound source localization system according to claim 1, wherein the sound source localization unit learns the SITDs and localizes the sound source using the learned SITDs.

4. The sound source localization system according to claim 1, further comprising a first filter for evaluating the Gaussian mean of the SITDs and removing SITDs of which errors are greater than a predetermined value based on the evaluated mean, between the time-difference extraction unit and the sound source localization unit.

5. The sound source localization system according to claim 1, further comprising a second filter for passing only SITDs within a voice band among the SITDs, between the time-difference extraction unit and the sound source localization unit.

6. The sound source localization system according to claim 1, further comprising a third filter for passing only SITDs of which coefficients are smaller than a predetermined threshold, between the time-difference extraction unit and the sound source localization unit.

7. A sound source localization method, comprising:

receiving a signal as an input from a sound source;

decomposing the signal into time, frequency and amplitude using a sparse coding;

extracting a sparse interaural time difference (SITD) for each frequency; and localizing the sound source using the SITDs.

8. The sound source localization method according to claim 7, wherein the decomposing of the signal performs the sparse coding using a gammatone filterbank.

9. The sound source localization method according to claim 7, wherein the localizing of the sound source comprises:

learning the SITDs; and localizing the sound source using the learned SITDs.

10. The sound source localization method according to claim 7, further comprising evaluating the Gaussian mean of the SITDs and removing SITDs of which errors are greater than a predetermined value based on the evaluated mean, between the extracting of the SITDs and the localizing of the sound source.

11. The sound source localization method according to claim 7, further comprising passing only SITDs within a voice band among the SITDs, between the extracting of the SITDs and the localizing of the sound source.

12. The sound source localization method according to claim 7, further comprising passing only SITDs of which coefficients are smaller than a predetermined threshold, between the extracting of the SITDs and the localizing of the sound source.

* * * * *